US009382100B2

(12) United States Patent
Szentistvany et al.

(10) Patent No.: US 9,382,100 B2
(45) Date of Patent: Jul. 5, 2016

(54) STAIRLIFTS

(75) Inventors: Andreas Csaba Szentistvany, Andover Hampshire (GB); Martin Snook, Colchester (GB)

(73) Assignee: Stannah Stairlifts Limited, Hampshire (GB)

( * ) Notice: Subject to any disclaimer, the term of this patent is extended or adjusted under 35 U.S.C. 154(b) by 233 days.

(21) Appl. No.: 14/003,168

(22) PCT Filed: Mar. 5, 2012

(86) PCT No.: PCT/GB2012/050481

§ 371 (c)(1),
(2), (4) Date: Nov. 18, 2013

(87) PCT Pub. No.: WO2012/120286

PCT Pub. Date: Sep. 13, 2012

(65) Prior Publication Data

US 2014/0060976 A1 Mar. 6, 2014

(30) Foreign Application Priority Data

Mar. 4, 2011 (GB) ..... 1103716.5

(51) Int. Cl.
*B66B 9/08* (2006.01)

(52) U.S. Cl.
CPC ..... *B66B 9/08* (2013.01); *B66B 9/0838* (2013.01); *Y10T 29/49826* (2015.01)

(58) Field of Classification Search
CPC ..... B66B 9/08; B66B 9/0815; B66B 9/0838; Y10T 29/49464; Y10T 29/49465; Y10T 29/49826
USPC ..... 74/424.78; 187/202
See application file for complete search history.

(56) References Cited

U.S. PATENT DOCUMENTS

| | | | | | |
|---|---|---|---|---|---|
| 1,409,319 | A * | 3/1922 | Vaughan | B63H 23/00 | 74/410 |
| 3,252,349 | A * | 5/1966 | Widdrington | F16H 1/22 | 74/411 |
| 4,282,767 | A * | 8/1981 | Guichard | F16H 1/225 | 74/410 |
| 4,444,071 | A * | 4/1984 | Guichard | B60S 1/16 | 29/434 |
| 4,589,299 | A * | 5/1986 | Kobayashi | F16H 1/225 | 74/424.7 |
| 4,754,660 | A * | 7/1988 | Kobayashi | F16H 1/225 | 74/410 |

(Continued)

FOREIGN PATENT DOCUMENTS

| | | |
|---|---|---|
| GB | 2484709 | 4/2012 |
| WO | WO-2006/001694 | 1/2006 |

(Continued)

OTHER PUBLICATIONS

International Search Report and Written Opinion of PCT/GB2012/050481 (Sep. 5, 2012).

*Primary Examiner* — Minh Truong
(74) *Attorney, Agent, or Firm* — Dinsmore & Shohl LLP; Douglas L. Wathen

(57) ABSTRACT

The invention provides a levelling system for the chair of a stairlift, a characteristic feature of the system being the provision of a safety back-up or locking mechanism that will lock the position of the chair in the event of failure within the levelling drive. This locking mechanism preferably includes a locking wheel that is in partial mesh with a geared wheel forming part of the levelling drive. In the event of failure within the drive the locking wheel meshes to lock the position of the chair.

18 Claims, 6 Drawing Sheets

(56) References Cited

U.S. PATENT DOCUMENTS 5,040,429 A * 8/1991 Del Castillo ..... B25J 9/102 74/424
5,145,467 A * 9/1992 Periou ..... B60J 7/0573 475/162
5,875,681 A * 3/1999 Gerrand ..... B60S 1/166 310/83
8,496,069 B2 * 7/2013 Gendelman ..... A01B 33/028 172/42
9,027,427 B2 * 5/2015 Economou ..... F16H 3/363 74/434
2005/0279580 A1 * 12/2005 Szentistvany ..... B66B 9/0838 187/201
2011/0000744 A1 * 1/2011 Smith ..... B66B 9/0838 187/202
2014/0151157 A1 * 6/2014 Hall ..... B66B 9/0838 187/202

FOREIGN PATENT DOCUMENTS

WO WO-2008/142372 11/2008
WO WO-2012/052725 4/2012

* cited by examiner

STAIRLIFTS

REFERENCE TO RELATED APPLICATIONS

This application is a U.S. National Phase of PCT/GB2012/050481, filed Mar. 5, 2012, which claims priority to GB 1103716.5, filed Mar. 4, 2011, the contents of both of which are incorporated herein in their entirety.

FIELD OF THE INVENTION

This invention relates to stairlifts and, in particular, to the safety system of a stairlift.

BACKGROUND TO THE INVENTION

In a curved stairlift installation the angle of the stairlift rail varies with respect to a horizontal plane. As the stairlift carriage moves over a transition bend (a bend in a vertical plane) the chair mounted on that carriage, must be kept level. In the embodiment of stairlift described in our European Patent No. 0 738 232 the chair is pivotally mounted on the carriage and a chair levelling motor operates to keep the chair level as the angle of the rail varies.

An arrangement of the type shown in EP 0 738 232 gives rise to a concern that, in the event of failure of the chair levelling motor and/or transmission, the chair could rotate in an uncontrolled manner relative to the carriage. Obviously, in the event of such a failure, a person seated in the chair could be injured. Mindful of the possibility of such failures, EP 0 738 232 also describes the use of a back-up safety arrangement in which a pair of mercury switches trigger the release of a locking pin when the chair angle reaches a predetermined off-level upper limit on either side of a central, level, position. The locking pin, in turn, extends into a locating aperture in the chair interface so as to lock the position of the chair relative to the carriage. The locking mechanism also triggers the main safety circuit which brings the carriage to a halt.

Since the filing of EP 0 738 278 it has become commonplace to substitute a single analogue tilt sensor for the mercury switches however, in common with
the mercury switches, a tilt sensor only gives an output signal when the off-level limit is reached.

This off-level limit is typically 5° however, because the chair may have built up considerable momentum before the failure is detected, the locking mechanism triggered, and the locking mechanism engages, the applicable standards prescribe that that chair must be brought to a halt within 15° of vertical.

This problem is addressed in our International Patent Application WO2008/142372. This patent application describes an arrangement in which movement of the levelling drive, and rotational movement of the chair are separately monitored using encoders. In the event that the encoder readings vary, a spring loaded pin is released by a solenoid to engage in a slot formed in an indexing ring attached to the chair. The indexing ring is provided with a series of slots with the intention that, should the locking pin be released, it will engage in that slot which, when the pin is released, is located closest to the pin.

Whilst this solution offers significant improvements over that which preceded it, it still presents the following issues:

1. Response time in the event of failure is critical. Any failure of the levelling system must be detected, and the locking pin released and engaged in a slot in the indexing ring, within 15° of movement of the chair from the vertical. This has proved difficult to achieve on a consistent basis.

2. The slow response time has, in some instances, been due to backlash inaccuracies in one or both of the encoders, which inaccuracies are exacerbated by wear.
3. When released by the solenoid, the locking pin can skip the closest slot in the indexing ring and only engage in the second or third available slot. This makes the response time very unpredictable. More slots could be added to address this problem but, for a given diameter of indexing ring, this would then necessitate reducing the widths of the slots and diameter of the locking pin. The consequence of this would be to leave the locking pin susceptible to failure when subjected to the significant shock loads imposed when arresting the rotating chair. Similarly, adding slots to the indexing ring would reduce the material between adjacent slots, thus weakening the ring itself. In compact arrangements such as a stairlift carriage, significantly increasing the diameter of the indexing ring is not an option.
4. There is a preference, in the stairlift field, for safety facilities which are mechanically based rather than electrical/electronic based.

It is an object of the invention to provide a safety method and apparatus for a stairlift which will go at least some way in addressing the aforementioned problems; or which will at least provide a novel and useful choice.

SUMMARY OF THE INVENTION

Accordingly, in a first aspect the invention provides a method of providing a safety facility for a stairlift having a carriage moveable along a rail; a chair pivotally mounted on said carriage; a levelling motor operable to pivot said chair relative to said carriage; and a transmission linking the output of said levelling motor to said chair, said method being characterised in that it includes providing a geared surface which moves with pivotal movement of said chair; and a locking mechanism in at least partial mesh with said geared surface such that, in the event of failure of said transmission, said geared surface engages said locking mechanism.

In a second aspect the invention provides a stairlift having a carriage moveable along a rail; a chair pivotally mounted on said carriage; a levelling motor operable to pivot said chair relative to said carriage; and a transmission linking the output of said levelling motor to said chair, said stairlift being characterised in that it further includes a geared surface which is moveable with pivotal movement of said chair; and a locking mechanism in at least partial mesh with said driven gear such that, in the event of failure of said transmission, said geared surface engages said locking mechanism.

Preferably said locking mechanism is operatively connected to said transmission.

Preferably said geared surface is incorporated in a wheel, an axis of said wheel coinciding with a pivot axis of said chair.

Preferably said wheel engages with or forms part of said transmission.

Preferably said locking mechanism comprises or includes a rotating gear, the speed of said rotating gear being linked to the speed of rotation of said transmission.

Preferably said locking mechanism and said transmission incorporate substantially identical worm gears engaging a worm wheel.

Preferably said worm gears are positioned to engage different arcs of said worm wheel.

Preferably said worm gears are positioned to engage said worm wheel substantially at opposite ends of a diameter of said wheel.

Preferably said worm gears are interconnected by a belt drive configured to effect contra-rotation of the locking gear relative to the transmission gear.

In one embodiment said transmission includes a primary drive stage and a secondary drive stage.

Preferably said locking mechanism is connected to said secondary drive stage.

Preferably said locking mechanism and said secondary drive stage each include a worm gear mounted to rotate about a substantially common axis.

Preferably said secondary drive stage is non back-winding.

Many variations in the way the present invention can be performed will present themselves to those skilled in the art. The description which follows is intended as an illustration only of two possible means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

One preferred form of the invention will now be described with reference to the accompanying drawings in which.

DETAILED DESCRIPTION OF WORKING EMBODIMENTS

Figure 1:
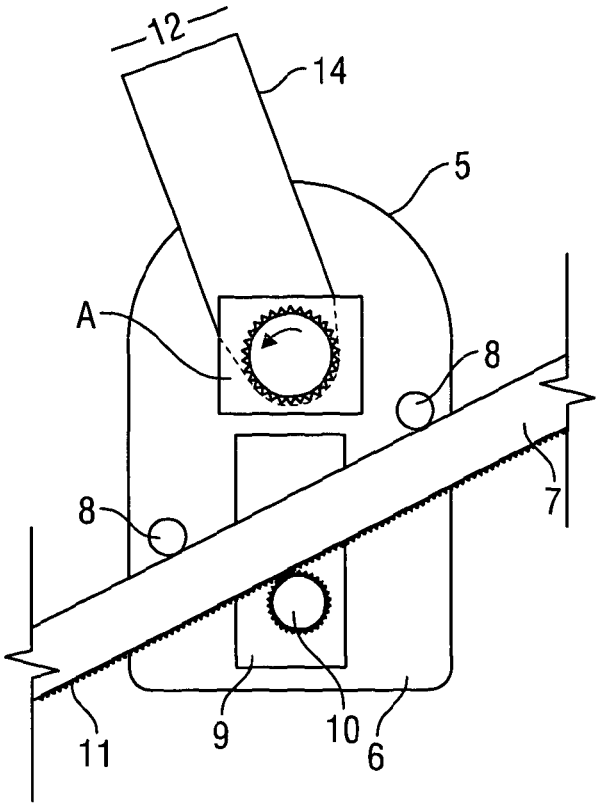
FIG. 1: shows a schematic rear view of a stairlift according to the invention.

Referring to FIG. 1, the invention provides a stairlift 5 which includes a carriage 6 supported on a rail 7 by rollers 8. Mounted within the carriage 6 is a main drive motor 9 having a drive pinion 10 mounted on the output thereof.

The drive pinion 10 engages a rack 11 so that as the drive motor rotates, the carriage 6 is driven along the rail 7.

A chair 12 is mounted on the carriage 6 so that the chair can pivot relative to the carriage 6. As shown the chair is mounted on a chair interface 14 and it is the interface which is directly and pivotally connected to the carriage.

The pivotal movement of the chair 12 relative to the carriage 6 is effected by a motor and transmission which will be described in greater detail below. The motor and transmission, together with a safety back-up arrangement also described in detail below, is contained with box A in FIG. 1.

Figure 3:
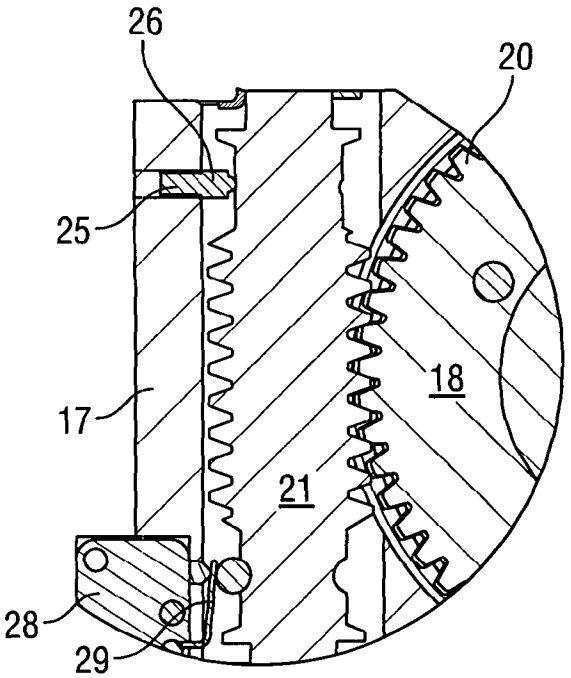
FIG. 3: shows a further enlarged view of that which is included in circle 'B' in FIG. 2.
Figure 2:
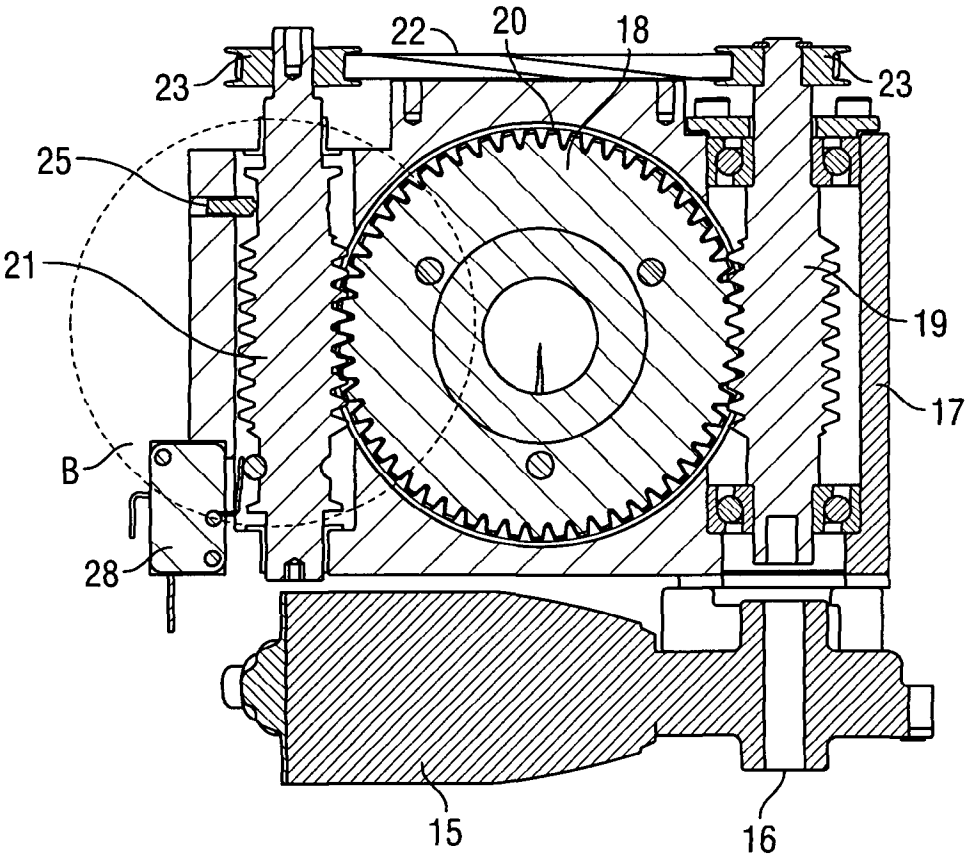
FIG. 2: shows an enlarged view of that which is shown schematically as 'A' in FIG. 1.

Turning now to FIGS. 2 & 3, a chair levelling motor 15 having a right-angled output shaft 16 is mounted on the lower edge of housing 17. The housing 17 is fitted over pinion 18 which, in turn, is fixed to the chair interface 14 co-axially with the pivot axis of the interface 14. Thus rotation of the pinion 18 effects pivotal movement of the interface 14 and chair 12 relative to the carriage 6.

A transmission is provided to transmit the rotation of the motor 15 to the pinion 18. In the form shown this transmission comprises a first worm gear 19 mounted on the output shaft 16 of the motor 15 and arranged to fully mesh with teeth 20 provided about the periphery of the pinion 18 which will be referred to hereafter as a worm wheel. For stairlift seat levelling applications such as described herein, the worm wheel 18 will rotate clockwise and anti-clockwise through a maximum of about 90°.

In our European Patent (EP) 0 738 232 we describe a method of controlling the operation of the motor 15 to ensure that the chair is maintained level as the angle of the rail 7 varies relative to a horizontal plane, however other forms of levelling are also possible and the present invention is not limited in application to the levelling arrangement described in EP0738232.

The present invention has been devised to ensure safety is maintained in the event of failure within the chair levelling motor 15, between the output shaft 16 and the first worm gear 19, or between the first worm gear 19 and the worm wheel 18. In the absence of a suitable safety mechanism, failure of any of these types would result in uncontrolled rotation of the chair 12 and likely injury to a person seated in the chair.

In accordance with the invention a safety back-up arrangement is provided comprising a locking mechanism which is in a least partial mesh with a geared surface. The geared surface, and thus the locking mechanism, move with pivotal movement of the chair in a manner that maintains the partial mesh between the two components yet also maintains a clearance between the two. However, in the event of failure in the chair levelling drive, the locking mechanism and geared surface can engage and lock the position of the chair relative to the carriage.

We have found it convenient to incorporate the geared surface of the back-up arrangement into the worm wheel 18 and to configure the locking mechanism as a second worm gear 21. The second worm gear 21 is rotated in sync with the first worm gear 19 and this can be readily effected by positioning the worm gears to engage opposite ends of a diameter of the worm wheel 18 and inter-linking the gears to ensure synchronicity. In the form shown the worm gears are interconnected using a cross-over belt 22 which runs between pulleys 23 fixed to the upper edges of the gears 19 & 21. This arrangement causes the second worm gear 21 to contra-rotate relative to the first worm gear 19. As an alternative the gears could be interconnected using a gear train or flexi-drive arrangement. As a further alternative the worm gear 21 could be powered by an independent motor and gearbox controlled to operate, in reverse, at a speed linked to that of the motor 15 and worm gear 19.

Figure 7:
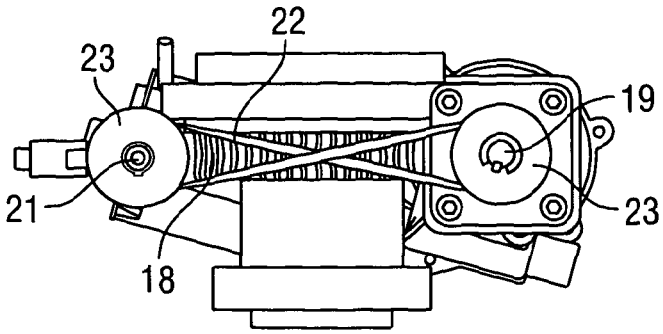
FIG. 7: shows a view along the line 7-7 in FIG. 4.

It will be seen from FIG. 2 that, whilst the worm gear 19 is fully meshed with the worm wheel 18, the worm gear 21 is only partially meshed. This can be seen more clearly in FIG. 3 which shows the connection between the second worm gear 21 and the worm wheel 18 in larger scale although it must be appreciated that the clearance is not entirely evident because of the scalloped tooth form (see FIG. 7) of the worm wheel 18. By contra-rotating the second worm gear 21 in sync with the first worm gear 19 we can ensure that, whilst clearance between the worm gear 21 and the worm wheel is minimal although existing, no drive is imparted between the worm gear 21 and the worm wheel 18. However it will be appreciated that, in the event of a failure of the levelling drive, the worm wheel will only rotate an extremely small amount before the overlap created by partial meshing leads to the worm wheel 18 engaging with the second worm gear 21.

An advantage of using a worm gear as the back-up locking gear is that the worm gear 21 is self-locking and will not back-drive. Further, should wear between the drive worm gear 19 and the worm wheel 18 get to such an extent as to allow the worm wheel 18 into contact with the second worm gear 21, the resultant torque would cause the belt 22 to slip or jump with respect to the pulleys 23 thus leading to the system locking and the stairlift being brought to a halt.

As well as locking the worm wheel 18 to the second worm gear 21 in the event of failure in the levelling drive, the invention also provides a facility for cutting power to the main stairlift drive motor 10 and the levelling motor 15 in the event of the safety back-up being activated. In the embodiment shown this facility allows the second worm gear 21 to be linearly displaced along its axis in a manner which will be better understood with reference to FIGS. 4 to 6.

Figure 4:
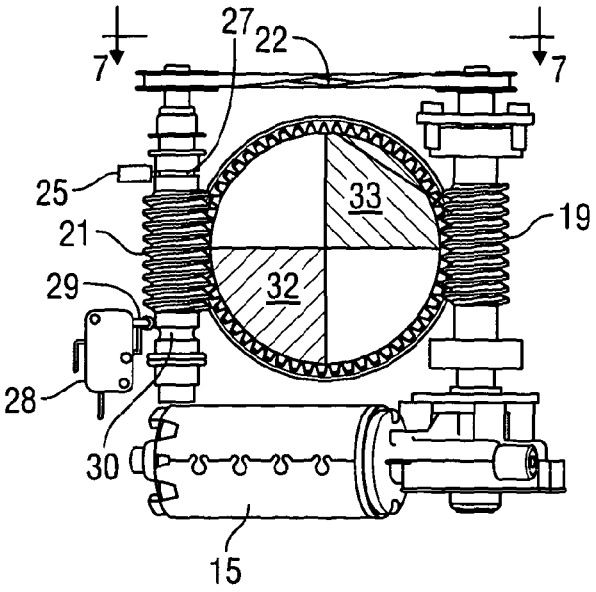
FIG. 4: shows a view of a level drive and safety back-up system according to the invention in its normal operating configuration.
Figure 5:
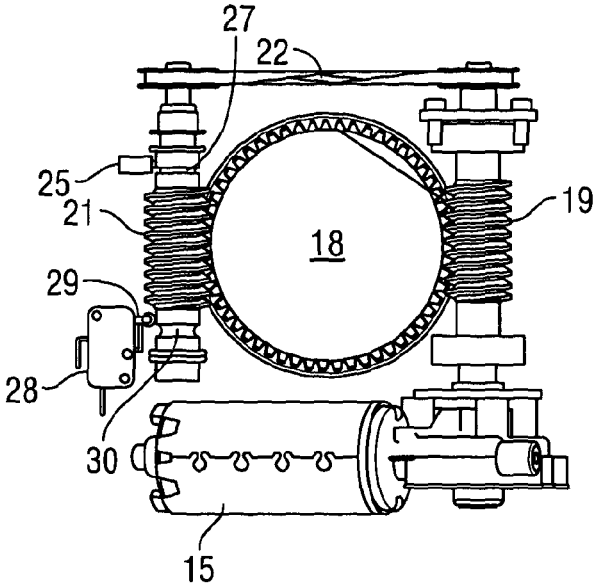
FIG. 5: shows a view similar to FIG. 4 but with the back-up safety activated in a first mode.

FIG. 4 shows the drive and safety back up system according to the invention in a normal operating configuration. The second worm gear 21 is held in a fixed axial position by a spring loaded plunger 25 mounted in the housing 17, the plunger 25 having a balled distal end 26 (FIG. 3) that engages in an upper groove 27 provided about the periphery of the gear 21. A safety cut-out switch 28 is further provided having an operating arm 29 normally engaged in a further, lower, peripheral groove 30 provided about the second worm gear 21.

Figure 6:
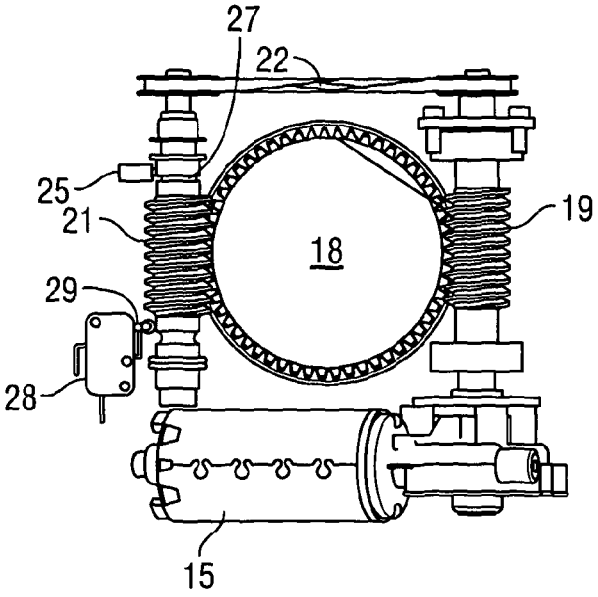
FIG. 6: shows a view similar to FIGS. 4 & 5 but with the back-up safety activated in a second mode.

Depending on the orientation of the stairlift in the event of failure in the levelling drive system and the resultant engagement of the second worm gear 21 by the worm wheel 18, the second worm gear 21 will be displaced axially up (FIG. 5) or axially down (FIG. 6). In both cases, axial movement of the gear 21 causes the holding force imposed by the plunger 25 to be overcome and, in turn, causes the operating arm 29 of safety switch 28 to be displaced from its groove 30. As the arm 29 is displaced it operates the switch 28 causing power to the main drive motor 10, and levelling motor 15, to be cut.

Figure 8:
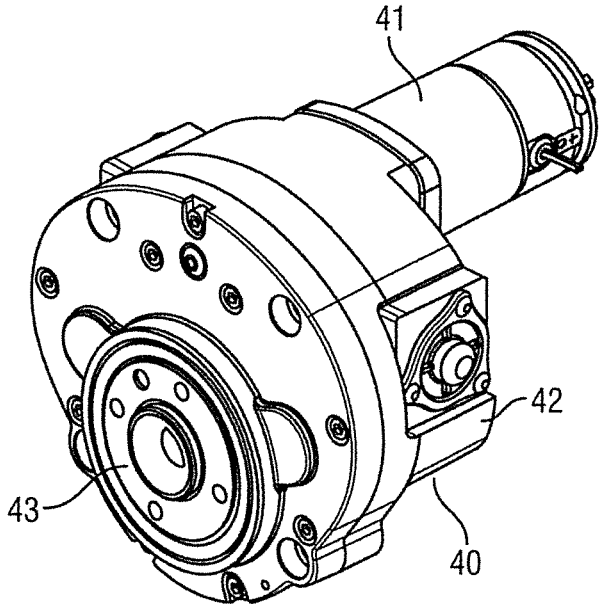
FIG. 8: shows an isometric view of a second embodiment of level drive and safety back system according to the invention.

Turning now to FIGS. 8 to 13, a further unit 40 is shown for effecting stairlift seat levelling, the unit 40 including a safety back-up facility to ensure passenger safety in the event of drive failure within the levelling facility. As with the embodiment described above the unit 40 is intended to occupy Box A in FIG. 1 and, as shown in FIG. 8, broadly comprises motor 41, transmission housing 42, and output hub 43 to which chair interface 14 is attached. The unit is fixed to the stairlift carriage 6 by any suitable fixings between the carriage and the housing 42.

In broad terms the transmission housing 42 contains a primary drive stage, a secondary drive stage and a safety back-up stage or locking mechanism to ensure safety in the event of failure of secondary drive stage. In this particular embodiment the safety back-up stage does not provide back-up in the event of failure in the primary drive stage however failure of the primary drive stage is effectively addressed by making the secondary drive stage non back-driving i.e. the internal friction or resistance of the secondary drive stage is such that the secondary drive stage will, effectively, lock in the event of failure in the primary drive stage.

Figure 10:
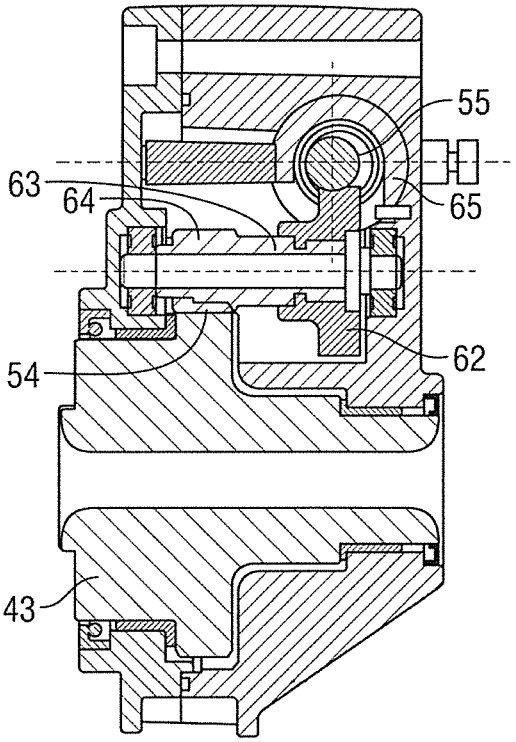
FIG. 10: shows a vertical, displaced section through the apparatus shown in FIGS. 8 & 9.

As can be seen in FIGS. 9 to 13, a primary drive worm gear 44 is mounted on the output shaft of motor 41 for rotation therewith, the worm gear 44 meshing with primary drive worm wheel 45. The primary drive worm wheel 45 is mounted or formed at the inner end of secondary drive shaft 46, the drive shaft 46 being mounted between a bearing 47 and a supporting end cap 48. Axially spaced along secondary drive shaft 46, from the worm wheel 45, is secondary worm gear 50 which, in turn, meshes with secondary drive worm wheel 51. Secondary drive worm wheel 51 is mounted on the inner end of transfer shaft 52, the shaft 52 having a drive pinion 53 mounted or formed at the outer end, which pinion 53 meshes with a complimentary gear surface 54 on the output hub 43. Whilst the exact configuration of the worm wheel 51, the transfer shaft 52 and the pinion 53 may be difficult to ascertain from the drawings, it is essentially the same as that provided for the safety back-up stage that is shown in FIG. 10 and which will be described in greater detail below.

Through the combination of gears described, rotation of the drive motor 41 is thus transmitted to rotation of the hub 43 to effect levelling of the stairlift chair.

The safety back-up stage is similar in configuration to the secondary drive stage described above. In the form shown the safety back-up stage comprises a safety main shaft 55 that is co-axial with the secondary drive shaft 46. The safety main shaft 55 is supported at one end by the secondary drive shaft 46 and, at the other end, by a further supporting end cap 56. At the inner end of the safety main shaft 55 is a forked spigot 57 that is engaged in an axial bore 58 provided in the secondary drive shaft 46. This arrangement allows the safety main shaft 55 to slide axially with respect to the secondary drive shaft 46 for reasons that will become apparent from the description that follows. A dowel pin 60 is mounted on the secondary drive shaft 46 and projects diametrically through the bore 58 and through the forked spigot 57 to transfer rotation of the shaft 46 to the safety main shaft 55.

As can be seen the safety main shaft 55 also carries a worm gear 61 that is in approximate though non-contacting mesh with safety worm wheel 62. As is best seen in FIG. 10, the worm wheel 62 is mounted on the inner end of safety transfer shaft 63, the outer end of the transfer shaft 63 carrying a pinion surface 64 that also meshes with gear surface 54 on the hub 43.

To ensure that the worm gear 61 on safety main shaft 55 is only in approximate and non-contacting mesh with the safety worm wheel 62, the geared surfaces are formed with greater clearances than on the secondary drive side. Further, the safety worm wheel 62 is preferably fixed to safety transfer shaft 63 by a relatively fine toothed splined joint to enable the position of the worm wheel 62 to be adjusted to ensure that the requisite amount of clearance can be achieved.

In normal operation the safety worm wheel 62 is driven from the hub 43 which, in turn, is driven from the secondary drive stage. The safety main shaft 55 is driven in timed relationship from the secondary drive shaft 46. As described above, the configuration of the back-up is such that, during normal operation, there is no contact between the safety worm gear 61 and the safety worm wheel 62. What constitutes normal operation, and two modes of safety back-up, will now be described in greater detail with reference to FIGS. 11 to 13.

Figure 11:
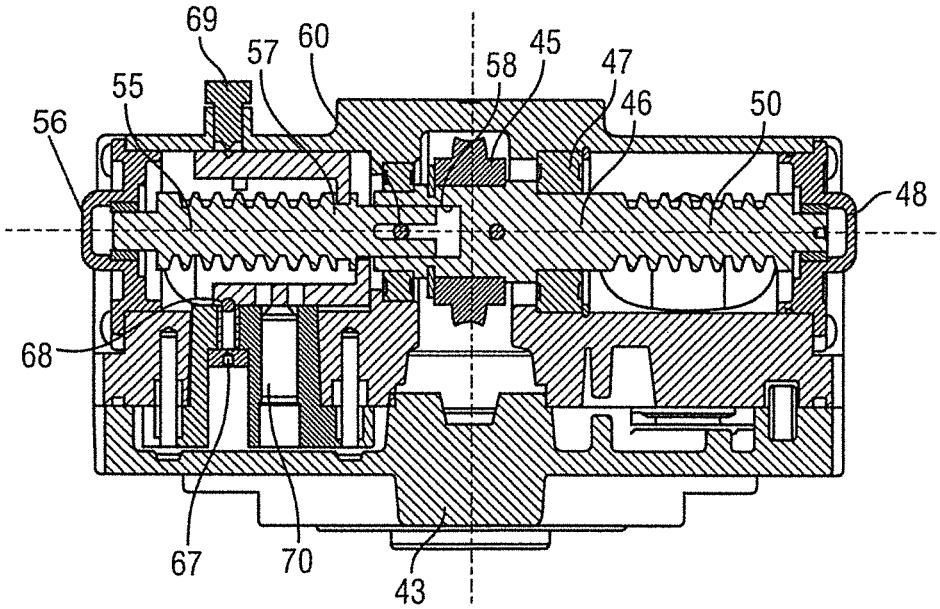
FIGS. 11 to 13: show different operating states of the apparatus shown in FIGS. 8 to 10.
Figure 9:
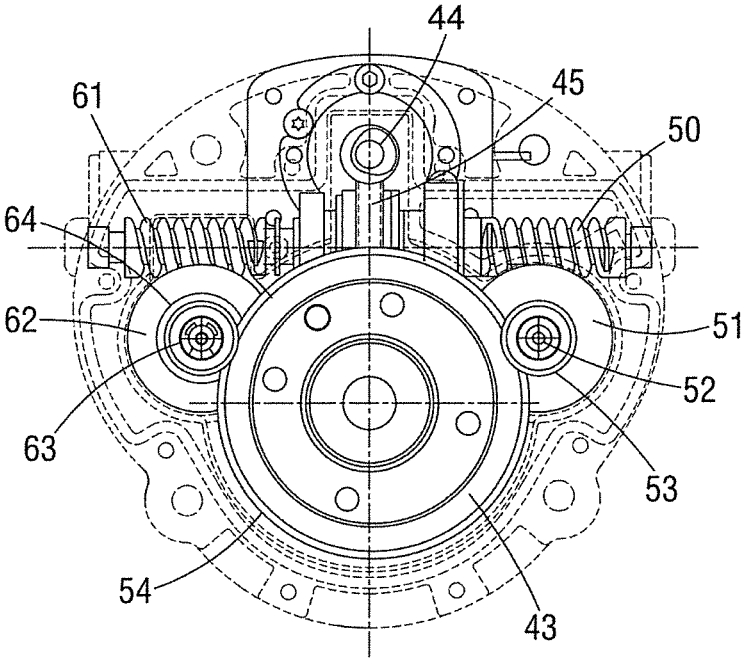
FIG. 9: shows a frontal, partly cut-away, view of that which is shown in FIG. 8.
Figure 12:
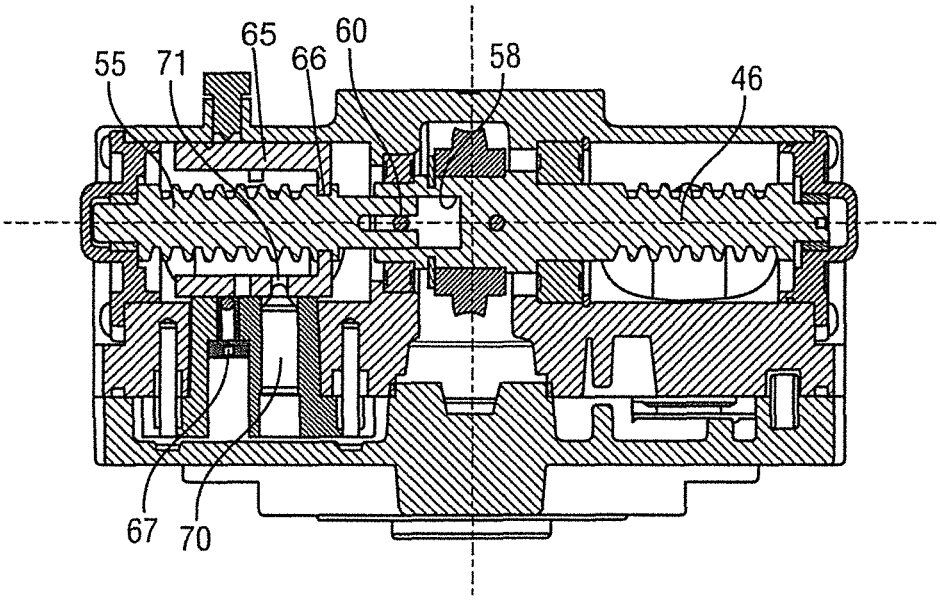
Figure 13:
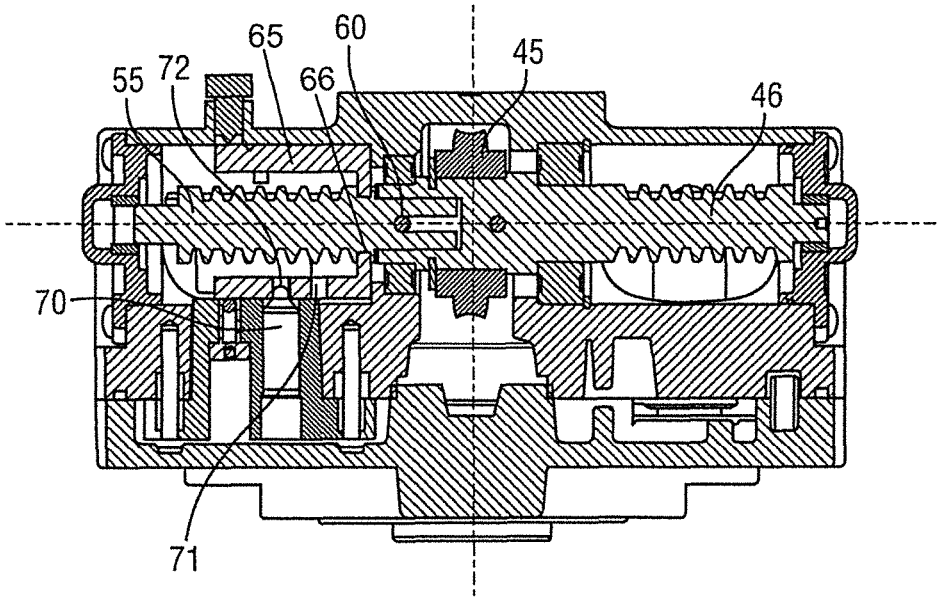

Before describing the different operating configurations, additional features of the safety back-up stage need to be described. As is best seen in FIGS. 11 to 13, the safety back up stage further includes a slider 65 that is supported within the transmission housing 42 and engages in an annular groove 66 provided in the surface of the safety main shaft 55. The arrangement means that the shaft 55 may rotate with respect to the slider 65 but that any axial displacement of the shaft 55 will also effect displacement of the slider.

In the normal operating position shown in FIG. 11 the axial position of the slider 65, and thus the main safety shaft 55, is held fixed by a detent plunger 67 which engages in a detent groove 68 provided in the outer surface of the slider 65. A power cut-out plunger 69 is also engaged in groove 68. In the event of failure in the secondary drive stage, the main shaft 55 and slider 65 are displaced axially in a manner that will now be described.

Depending on the position of the carriage on the rail, and the configuration or geometry of the rail, in the event of failure of the levelling drive, the chair interface may free fall to the right, as shown in FIG. 12, or to the left, as shown in FIG. 13. In both cases failure of the secondary drive will cause the secondary drive shaft 46 to stop rotating, and thus cause the safety main shaft 55 to stop rotating. However, the weight of the chair will cause the hub 43 to rotate and thus cause the safety worm wheel 62 to positively engage with the safety worm gear 61. When this occurs an axial force is applied to main safety shaft 55 which overcomes the resistance applied by the detent plunger 67 and the main shaft 55 and slider 65 are axially displaced.

If, as shown in FIG. 12, the chair interface is falling to the right, the safety main shaft 55 and slider 65 are displaced to the left. When the limit of available movement is reached a locking plunger 70 engages in right-hand locking aperture 71 in the slider to thus lock the unit against further movement. If, as shown in FIG. 13, the chair interface is falling to the left, the safety main shaft 55 and slider 65 are displaced to the right. When the limit of available right hand movement is reached locking plunger 70 engages in left-hand locking aperture 72 in the slider to lock the unit against further movement.

In both cases, as the slider 65 is displaced, the power cut-out plunger 69 is also displaced from detent groove 68 thus cutting power to the motors 10 and 41.

It will thus be appreciated that the levelling drive and safety back-up arrangement, at least in the case of the working embodiment described herein, has a number of significant advantages including:

1. Because in both embodiments the back-up includes a worm gear in at least partial mesh with a worm wheel, in the event of drive failure the main levelling wheel or hub can only rotate a very small amount before being locked by the safety back-up gear. The precise amount of movement can be adjusted in a predictable and controlled amount by varying the spacing between the back-up worm gear and worm wheel, and by controlling the available axial movement of the worm gear 21.
2. The back-up arrangement is extremely compact.
3. The arrangements described herein are purely mechanical in nature and fall squarely within existing safety standards.

The invention claimed is:

1. A method of providing a safety facility for a stairlift having a carriage moveable along a rail, the method including the steps of:

mounting a chair pivotally on said carriage;

providing a leveling motor operable to provide rotation of said chair relative to said carriage;

providing a transmission linking an output of said leveling motor to said chair, said transmission further including a geared surface that is rotatable with rotation of said chair;

providing a locking mechanism;

in a normal mode said leveling motor driving said transmission to provide rotation of said chair relative to said carriage, said locking mechanism being in non-contacting mesh with said geared surface; and in a failure mode an uncontrolled rotational movement of said chair relative to said carriage causing rotation of said geared surface which causes said locking mechanism to contact with said geared surface and preventing further pivotal movement of said geared surface and said chair.

2. A stairlift apparatus comprising:

a carriage moveable along a rail;

a chair pivotally mounted on said carriage;

a leveling motor operable to rotate said chair relative to said carriage;

a transmission linking an output of said leveling motor to said chair, said transmission further having a geared surface that is rotatable with rotation of said chair;

a locking mechanism;

wherein in a normal mode said leveling motor driving said transmission to rotate said chair relative to said carriage, said locking mechanism being in non-contacting mesh with said geared surface; and in a failure mode an uncontrolled rotational movement of said chair relative to said carriage causing rotation of said geared surface which causes said locking mechanism to contact with said geared surface and preventing further pivotal movement of said geared surface and said chair.

3. The stairlift apparatus of claim 2, wherein said locking mechanism is operatively connected to said transmission.

4. The stairlift apparatus of claim 3, wherein said locking mechanism comprises or includes a rotating gear, the speed of said rotating gear being proportional to the speed of rotation of said transmission.

5. The stairlift apparatus of claim 3, wherein said transmission includes a primary drive stage and a secondary drive stage.

6. The stairlift apparatus of claim 2, wherein said geared surface is incorporated in a wheel, an axis of said wheel coinciding with a pivot axis of said chair.

7. The stairlift apparatus of claim 6, wherein said wheel engages with or forms part of said transmission.

8. The stairlift apparatus of claim 2, wherein said locking mechanism comprises or includes a rotating gear, the speed of said rotating gear being proportional to the speed of rotation of said transmission.

9. The stairlift apparatus of claim 2, wherein said locking mechanism and said transmission each incorporate substantially identical worm gears engaging a worm wheel.

10. The stairlift apparatus of claim 9, wherein said worm gears are positioned to engage different arcs of said worm wheel.

11. The stairlift apparatus of claim 10, wherein said worm gears are positioned to engage said wheel substantially at opposite ends of a diameter of said worm wheel.

12. The stairlift apparatus of claim 9, wherein said worm gears are positioned to engage said wheel substantially at opposite ends of a diameter of said worm wheel.

13. The stairlift apparatus of claim 12, wherein said worm gears are interconnected by a belt drive configured to effect contra-rotation of the locking gear relative to the transmission gear.

14. The stairlift apparatus of claim 9, wherein said worm gears are interconnected by a belt drive configured to effect contra-rotation of the locking worm gear relative to the transmission worm gear.

15. The stairlift apparatus of claim 10, wherein said worm gears are interconnected by a belt drive configured to effect contra-rotation of the locking gear relative to the transmission gear.

16. The stairlift apparatus of claim 2, wherein said transmission includes a primary drive stage and a secondary drive stage.

17. The stairlift apparatus of claim 2, wherein said locking mechanism is connected to a secondary drive stage.

18. The stairlift apparatus of claim 17, wherein said locking mechanism and said secondary drive stage each include a worm gear mounted to rotate about a substantially common axis.

* * * * *